US009156533B2

(12) United States Patent
Mueller

(10) Patent No.: US 9,156,533 B2
(45) Date of Patent: Oct. 13, 2015

(54) CONTROL FOR TRIMMING ELEMENTS

(76) Inventor: Peter A. Mueller, Gattikon (CH)

( * ) Notice: Subject to any disclaimer, the term of this patent is extended or adjusted under 35 U.S.C. 154(b) by 0 days.

(21) Appl. No.: 14/111,885

(22) PCT Filed: Apr. 16, 2012

(86) PCT No.: PCT/CH2012/000087
§ 371 (c)(1),
(2), (4) Date: Dec. 31, 2013

(87) PCT Pub. No.: WO2012/139237
PCT Pub. Date: Oct. 18, 2012

(65) Prior Publication Data
US 2014/0129062 A1 May 8, 2014

(30) Foreign Application Priority Data
Apr. 15, 2011 (CH) ..... 675/11

(51) Int. Cl.
*B63H 5/125* (2006.01)
*B63B 39/06* (2006.01)

(52) U.S. Cl.
CPC ..... *B63H 5/125* (2013.01); *B63B 39/061* (2013.01)

(58) Field of Classification Search
CPC ..... B63H 5/125; B63B 39/061
USPC ..... 701/21
See application file for complete search history.

(56) References Cited

U.S. PATENT DOCUMENTS

| | | | | |
|---|---|---|---|---|
| 4,773,215 | A | 9/1988 | Winberg et al. | |
| 4,960,398 | A | 10/1990 | Potratz | |
| 5,385,110 | A * | 1/1995 | Bennett et al. | 114/285 |
| 6,085,684 | A * | 7/2000 | Cotton | 114/285 |
| 6,264,513 | B1 * | 7/2001 | Marsh | 440/53 |
| 6,354,237 | B1 * | 3/2002 | Gaynor et al. | 114/286 |
| 7,381,108 | B1 * | 6/2008 | Salmon | 440/6 |

OTHER PUBLICATIONS

Aug. 2, 2013 International Search Report issued in International Patent Application No. PCT/CH2012/000087.

* cited by examiner

*Primary Examiner* — Mary Cheung
*Assistant Examiner* — Brian P Sweeney
(74) *Attorney, Agent, or Firm* — Oliff PLC

(57) ABSTRACT

The invention relates to command input means (1) for balance assemblies (22) having a cover housing (15) to be intuitively turned and a rocker (4) as well as a quick button (6), which respectively trigger different lowering functions on the balance assemblies (22) in the bottom or the top rotary speed ranges, respectively, a neutral button (7) which neutralises all functions and causes the balance assemblies (22) to move fully upwards, and enables further functions by means of the controller (9), such as triggering of the adjustment of the balance assemblies (22) as a function of the rotary speed or by means of turning the steering wheel (20) in an automatic manner, and the signals can also be used at the same time for controlling the trim of a stern drive (16).

13 Claims, 3 Drawing Sheets

CONTROL FOR TRIMMING ELEMENTS

TECHNICAL AREA

The invention is based on command input means for balance assemblies for balancing stern drives and surface drives on water vehicles, according to the preamble of the first claim.

PRIOR ART

Push and rocker switches as command input means for balance assemblies are well known. Usually, simple rocker or push switches for activating the acting cylinders are employed for controlling port and starboard balance assemblies, wherein the commands for an independent upward or downward movement of such assemblies are provided via individual rockers or pushers. It is also known to input commands using a type of joystick, where both balance assemblies are activated at the same time when the joystick is respectively pushed forwards or pulled backwards, but when the joystick is pushed in a lateral direction, only one balance assembly is activated.

Balance assemblies are used for correcting the position of water vehicles and are moved into position by means of acting cylinders either hydraulically with a predefined pressure and a specified flow rate or electrically via a given voltage and a corresponding spindle.

In order to sense the position of the balance assemblies, electrical or mechanical rotary travel indicators are used, which are detected by means of travel sensors in the lifting cylinder or are detected via a mechanical link with the balance assemblies.

A large number of boats have stern drives, rapid water vehicles have surface drives, by means of which the propeller is controlled, i.e. they are used to steer the vehicle but also to trim the hull. Trimming is carried out by means of buttons, which are usually located directly on the throttle or reverse lever. A rudimentary automatic trimming of stern drives is described in U.S. Pat. Nos. 4,773,215 and 4,960,398.

DEPICTION OF THE INVENTION

The invention is based on the object of enabling a multifunctional and safe control of the balance assemblies via command input means and of adapting the command input means in such a way that an intuitive command input, e.g. a certain hand movement on the command input device, results in a rectification movement of the vehicle. In addition to this it is ideally possible, due to the sensors provided and an associated controller, to integrate also the trimming of the stern drive or of a surface drive, in particular during start-up of the water vehicle.

The control of balance assemblies is usually carried out via rocker switches. If the water vehicle is in a tilted position, e.g. caused by a unilateral weight shift or by wind pressure, the vehicle can be brought back into the horizontal position by means of balance assemblies. To this end, however, the corresponding buttons have to be pressed. The command input according to the invention relates to a control dial that is intuitively rotated in accordance with how the vehicle is supposed to be brought back from its tilted position into its upright position. If the water vehicle is tilting towards the right (starboard), the vehicle will be raised back up again by turning the rotary knob towards the left (port) by activating the corresponding balance assembly. Optical feedback is provided on account of the fact that the control dial carries a symbol that indicates in which direction the water vehicle is being moved, or by means of a separate display on the dashboard. In order to lower the bow in the case of swell or in the case of an unfavourable weight distribution, the rotary knob is provided with "scroll"-like means designed as a rocker, which also allow the command to be carried out intuitively, which means, if the rocker is pressed forward, the bow is lowered, if the rocker is pulled backwards, the bow is relieved. Any commands of the rocker will always apply to both balance assemblies at the same time.

In order to move a balance assembly into the desired position, the rocker button has to be pressed down for a corresponding length of time, until the desired position has been reached. In the case of a radially mounted button, which is not dissimilar to a pushbutton on a chronometer, pre-programmed figures can be retrieved by tapping and the balance assembly is automatically moved to the set-point by means of programs stored in a controller.

It is desirable for the balance assemblies to move slowly in order to enhance the adjustment precision. On the other hand, it may be advantageous to set the balance assemblies as quickly as possible, such as e.g. during a water-ski start, so that the bow of the water vehicle does not excessively lift during the start and the vehicle will therefore start planing sooner. By integrating the engine speed information, the balance assemblies can be automatically moved into the fully lowered position by means of a simple algorithm, and additional means can be used to increase the adjustment rate.

However, a radially mounted button can also be used to trigger the command for moving the balance assembly into the fully lowered position in advance. A further radially mounted button allows the balance position to be neutralised at the push of a button, which means for example that the balance assembly is automatically moved into the fully raised position.

Moreover, by detecting the rotary speed and by using the controller, the balance assembly can, again automatically, be moved back up again when the rotary speed has dropped below a certain level.

The steering wheel can also be used as a command input device, in particular if for example the balance assembly on the port side is lowered and the water vehicle changes its direction towards the port side, then it makes sense to move the balance assembly back up accordingly, so that the control pressure on the steering wheel, or the rudder, is decreased and the water flow into the propeller, e.g. in the case of a stern drive, is not impeded.

In the case of heavy water vehicles or very fast vehicles having a high propeller pitch, the rotary speed does not change very much during acceleration from low speeds and it can therefore become difficult for the controller to detect such an acceleration phase. To this end, therefore, the angular change of the throttle lever over time can be used as the measurement variable.

Since sensors, a controller having its own software and, if necessary, a pressure reservoir for balance assembly activation have been provided, these elements can also be used in particular for the acceleration mode of the water vehicle from low speeds. In a normal layout, a stern drive, or a surface drive, is in a position that allows the propeller current to be aligned with the hull of the water vehicle. In the acceleration mode it is advantageous for the stern drive, which is here also representative of other propeller pivot means, to be drawn towards the hull, so that the propeller thrust is directed obliquely downwards and thus lifts the stern of the water vehicle, or the bow is lowered and the vehicle can therefore reach the planing phase more quickly. If the controller detects the acceleration phase from low rotary speeds and thus the low speed of the water vehicle, the balance assemblies are therefore supposed to be moved downwards as quickly as possible, at the same time the stern drive should also start the start-up mode. Once the water vehicle has reached a certain speed or the pilot moves the throttle lever backwards, the corresponding signal for recovering the standard position of the balance assemblies and the stern drive(s) is selected. If the rotary speed remains high, the stern drive can be trimmed further, either due to a GPS signal or a time value, so that the propeller thrust is directed obliquely upwards and the bow is relieved, and in this way the water vehicle reaches a higher speed.

According to the invention, this is achieved by means of the features of the first claim.

It is the essence of the invention to enhance security during positioning of the balance assemblies by using command input means that can be operated intuitively, to relieve the pilot by way of automated processes as well as to adjust the balance assemblies as needed to a desired position value either faster or slower, and so that the signals can also be used at the same time for controlling the trim of a stern drive.

Further advantageous embodiments of the invention will become evident from the dependent claims.

BRIEF DESCRIPTION OF THE DRAWINGS

Embodiment examples of the invention will be explained in more detail below by means of the drawings. In the various figures, like elements have been identified using the same reference numerals, wherein.

Only the elements essential for providing an immediate understanding of the invention have been schematically shown.

WAY OF IMPLEMENTING THE INVENTION

Figure 1:
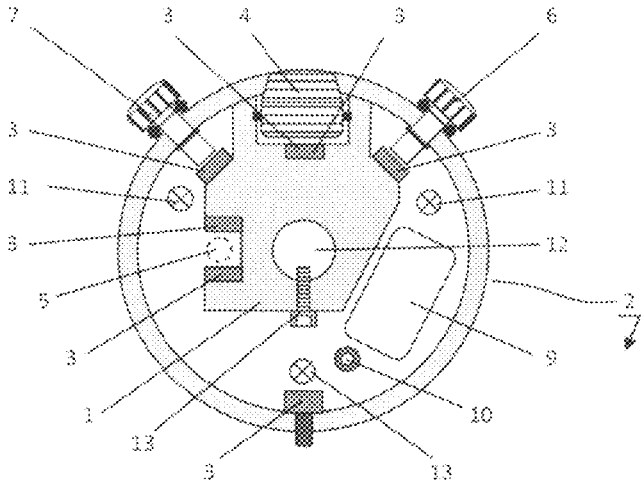
FIG. 1 shows a schematic top view of the chassis of the command input means including the micro-switches on a rocker, on the radial buttons, on the contact pin and the micro-switch for the underwater lighting, as well as the controller.

FIG. 1 shows a schematic top view of the chassis 1 of the command input means 2 with the micro-switch 3 on the rocker 4, two opposite micro-switches 3 for the contact pin 5 as well as a micro-switch 3 on the radial quick button 6 and on the neutral button 7, as well as a micro-switch 3 on the underwater lighting button 8. Also provided on the chassis 1 are the controller 9 with the cable feed-through 10, the fixing screws 11 as well as the bushing 12 with the retaining screw 13 as well as the screw 14.

Figure 4:
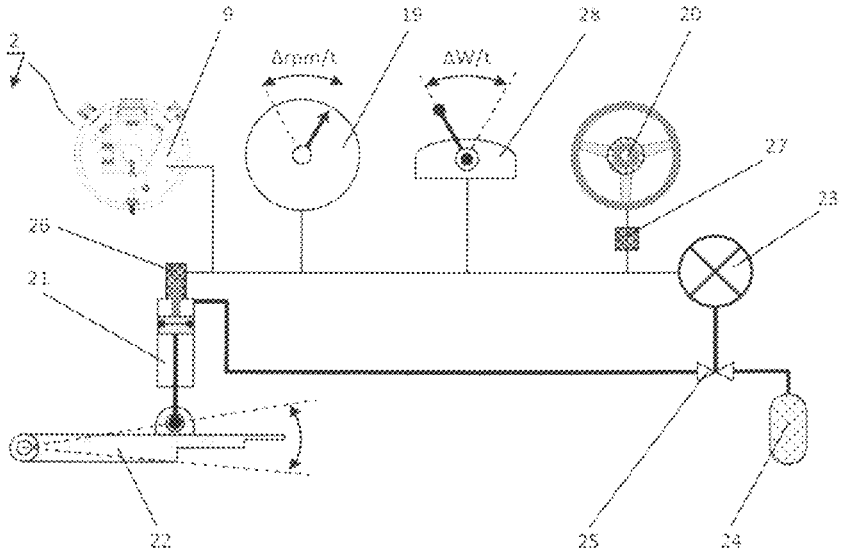
FIG. 4 shows a functional diagram of the balance assembly control including the command input means, the rotary speed or throttle lever and the steering wheel as well as the acting cylinder with the engine and the pressure reservoir for varying the balance assembly speed.

In order to bring an inclined water vehicle back into an upright position, balance assemblies 22 as shown in FIG. 4 are used. Instead of using, as is conventional, a rocker switch or a joystick that is operated crosswise, command input means 2 that can be rotated by just a few degrees are intuitively turned in the correct direction of rotation, which input means thus issue a command to the corresponding micro-switch 3 to drive the corresponding balance assemblies 22. In the case of an overcorrection, if the water vehicle is now inclined too far towards the other side, the command input means 2 can now be used to turn correspondingly in the opposite direction, which can also be optically seen from FIG. 2, which shows the cover housing 15 by means of the pictogram 18, so that the logic can be visualised as to what the water vehicle should or will do if it is turned by the command input means 2 to one or the other side. In case the bow of the water vehicle is too high, the bow can be pressed downwards by the balance assemblies 22 or the stern of the water vehicle is raised. To this end, both balance assemblies 22 are moved downwards at the same time, which is controlled by means of a separate button, the rocker 4. This handling is also intuitive, for as long as it is pressed forwards, which can be simply done using one finger, the bow of the water vehicle is pressed downwards. If the rocker 4 is pulled, the bow will be lifted up again.

For each water-ski start and for each full throttling out of a port, in order to reach in this way planing of the water vehicle as quickly as possible, in order to save fuel during cruising, the balance assemblies 22 should be lowered in advance or rapidly. This can be done automatically as described in FIG. 4 or can be prepared in advance so that, when full throttle is employed, the balance assemblies 22 are in the correct position for such a case, namely completely down. This is done by tapping the quick button 6, as a result of which the two balance assemblies 22 are lowered together into the bottom angular position, automated by means of the controller 9 or a time relay (not shown here). From a preselected engine speed onwards, the function of the quick button 6 changes from a large stroke action, which reaches up to the fully lowered position of the balance assemblies 22, to a limited stroke action.

Further, a neutral button 7 is located on the command input means 2, which neutralises the balance assemblies 22 in case they are positioned differently, by moving both balance assemblies 22 upwards, so that they no longer have a special influence on the orientation of the water vehicle.

Figure 5:
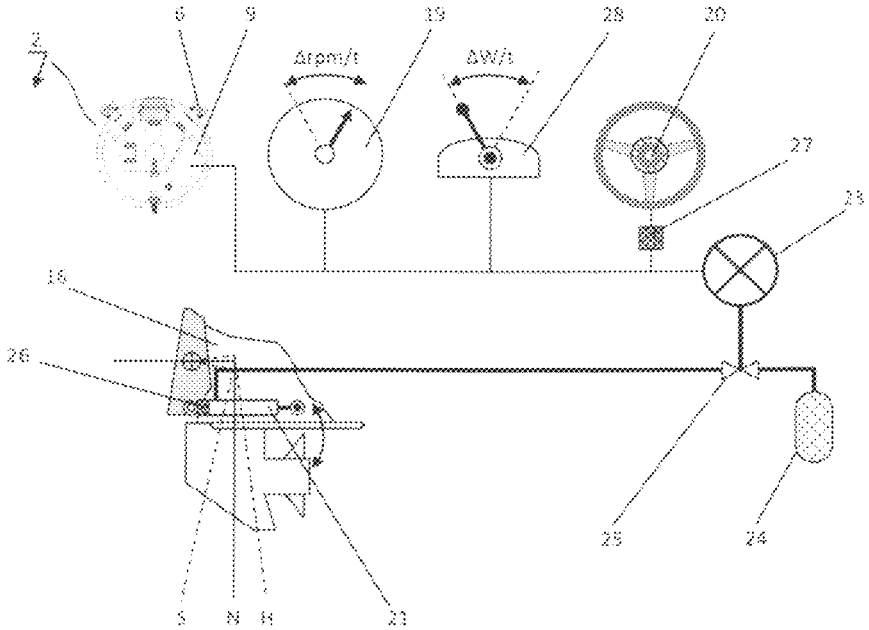
FIG. 5 shows a functional diagram of the balance assembly control including the command input means, the rotary speed or throttle lever and the steering wheel as well as the acting cylinder with the engine and the pressure reservoir for varying the trim of the stern drive.

An underwater lighting button 8 completes the functionality of the command input means 2, as the underwater lamps 29, which are now oftentimes required, according to FIG. 5, instead of being integrated into the hull as usual and posing a risk with regard to the sealing of the hull, are fixed to the balance assemblies 22 or on the cover of the balance assemblies 22 as shown in FIG. 5. In order to avoid having to drill a further hole into the dashboard for the underwater lighting button 8, this is already an integrated component of the command input means 2.

Figure 2:
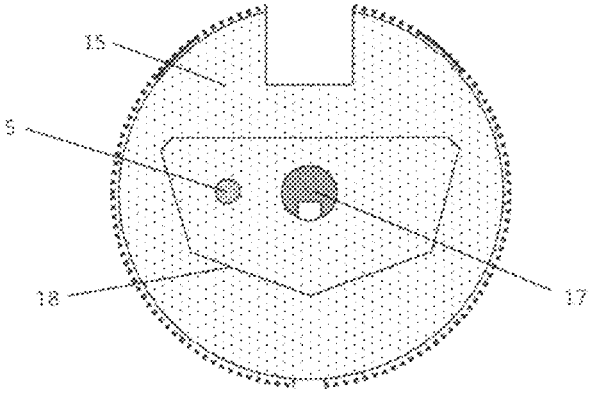
FIG. 2 shows a schematic top view of the rotary cover housing of the command input means with the contact pin and the centring axis.

The chassis 1 is fixed to the pilot's cabin by means of retaining screws 13 and the cables (not shown here) of the micro-switches 3 are combined in the controller 9 and a corresponding wiring harness is guided through the cable feed-through 10. Moreover, the bushing 12 is centrally located on the chassis 1 and leads through the rotary cover housing 15 as shown in FIG. 2, and the screw 14 prevents an unintended withdrawal of the cover housing 15 from the chassis 1. The micro-switches 3 have integrated compression springs, so that the resting position of the micro-switches is restored once they have been operated and released.

FIG. 2 shows a schematic top view of the rotary cover housing 15 of the command input means 2 with the contact pin 5, the centring axis 17 and the pictogram 18.

The cover housing 15 has been designed to be securely gripped and has a good anti-slip surface and includes a contact pin 5 which is located between the two micro-switches 3, and after turning the cover housing 15 about a predetermined rotary angle, a contact is made on the micro-switch 3, which triggers the movement of one of the balance assemblies 22. Further, the centring axis 17 is provided on the cover housing 15, which prevents, by means of the screw 14, an undesired lifting off of the cover housing 15. The pictogram 18 shows a symbolised view of the water vehicle from the rear in the driving direction, so that the user of the command input means 2 can easily imagine and also see in which orientation they want the water vehicle to be turned.

Figure 3:
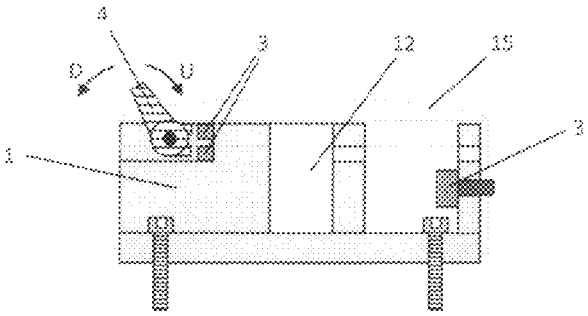
FIG. 3 shows a schematic lateral view of the chassis of the command input means with the micro-switches on the rocker as well as the micro-switches for the underwater lighting.

FIG. 3 shows a schematic lateral view of the chassis 1 of the command input means 2 with the two micro-switches 3 on the rocker 4, as well as the micro-switches 3 for the underwater lamp 29 in FIG. 5.

The rocker 4 on the chassis 1 is used to activate the two micro-switches 3 which will always activate the two balance assemblies 22 together so that, when the rocker 4 is pressed as indicated by arrow D, the bow of the water vehicle is lowered, and if the rocker 4 is pulled as indicated by arrow U, the vehicle is raised.

FIG. 4 shows a functional diagram of the balance assembly control including the command input means 2, the rotary speed by means of the rotary speed sensor 19 or the throttle lever 28, and also the steering wheel 20, as well as the acting cylinder 21 with the balance assembly 22 with the engine 23 and the pressure reservoir 24 and the lock valve 25 for varying the balance assembly speed, as well an odometer 26.

The balance assembly 22 is actuated by the acting cylinder 21, for example by a hydraulic cylinder, and pivots as soon as the engine 23 drives a hydraulic pump. The engine 23 is switched on and off by means of the micro-switches 3, either manually by means of the micro-switch 3 in the command input means 2 or by means of the controller 9 which receives data from the rotary speed sensor 19 or from the steering wheel 20 and therefore correspondingly actuates the acting cylinder 21 and thus automatically adjusts the balance assemblies 22.

In manual operation, the micro-switches 3 are kept depressed for as long as there is the desire to adjust the angular position of the balance assemblies 22. The micro-switches 3 on the quick button 6 respond to the pressure pulse and initiate a corresponding program that is stored in the controller 9, for example in such a way that by tapping the quick button 6, both balance assemblies 22 are fully lowered at the same time and will not be moved up again until a certain rotary speed has been reached on the engine or a certain time axis of the corresponding rotary speed has been traversed or the bottom pivot position of the balance assemblies 22 has been reached, and these are moved back up immediately, but slowly. This function can only be activated at lower rotary speeds of the engine. From a certain rotary speed onwards, e.g. from 2000 U/m onwards, the function changes and a tapping of the quick button 6 results in a lowering of the balance assemblies 22 over a certain period of time, e.g. half a second or, if the odometer 26 is used, about a certain angle such as 5°. Any further tapping after that leads to an additional angular adjustment of the balance assemblies 22, e.g. by another 5°. The pressing of the neutral button 7, which triggers a contact on the micro-switch 3, also has the effect of a program selection on the controller 9, so that both balance assemblies 22 together move fully upwards. If no odometer 26 is provided, the balance assemblies 22 remain activated over a time axis, which ensures that the balance assemblies 22 have securely arrived at the top.

By adjusting the balance assemblies 22 by means of the steering wheel 20, the steering of the water vehicle is improved, because if the left-hand balance assembly 22 is extended and the water vehicle is supposed to drive around a left-hand bend, the balance assembly 22 massively impedes the turning manoeuvre and impedes the flow of the water to the propeller. The controller 9 receives the steering wheel position from the steering wheel sensor 27 and the position of the balance assembly 22 from the odometer 26 and reduces in the above case the angle of attack of the balance assembly 22 or lifts it fully up. If the steering wheel 20 is adjusted back into the straight position, the balance assembly 22 returns back to its previous position.

Further, the rotary speed of the engine of the water vehicle can be detected by the controller 9, here indicated by the rotary speed sensor 19. If the basic rotary speed is low and the rotary speed of the engine changes abruptly, then this circumstance means to the controller 9 that it has to move the two balance assemblies 22 fully down at the same time and as rapidly as possible, because this means to the program that e.g. a water-ski start is being carried out or the water vehicle is leaving the port at full throttle, in order to reach planing as quickly as possible. As a result of the balance assemblies 22 having been extended downwards, cockpit visibility towards the front is improved and planing is reached sooner, so that fuel consumption is reduced. This change in rotary speed of the engine over time, Δrpm/t, is a parameter for adjusting the balance assemblies 22 by means of the controller 9, wherein the basic rotary speed 4 using the program is the relevant one and this is of great benefit to the pilot because they no longer need to take care of these functions, because the retracting of the balance assemblies 22 is also carried out automatically, namely from a certain rotary speed onwards or after a certain time interval or angular position, both balance assemblies 22 will be slowly moved upwards after they have been quickly and fully extended. The pilot can switch the automatic mode off at any time by means of the rocker 4 and can carry out a manual fine adjustment.

In the case of heavy water vehicles or rapid vehicles with a high propeller pitch, the change in rotary speed at full throttle may not be abrupt, which is not ideal for being detected by the controller 9 and therefore the angular adjustment time of the throttle lever 28 is used as the measurement variable.

The rapid extension of the two balance assemblies 22 at the same time as described above due to the corresponding Δrpm/t can be additionally supported by opening the lock valve 25, so that the high pressure and the volume in the pressure reservoir 24 flow into both acting cylinders 21 at the same time, in order to fully extend the balance assemblies 22 for example not in 6 seconds, but in 1 second.

If the rotary speed of the engine is reduced, e.g. below 1000 U/m, the two balance assemblies 22 will automatically move fully up, i.e. during slow travel or during port manoeuvres, a forgotten balance assembly 22 will not in any way interfere with the travel behaviour and also reduces fuel consumption.

If during the acceleration phase of the water vehicle the position of the throttle lever 28 is taken back, so that the rotary speed of the engine stabilises itself, then this is at the same time a signal for moving the balance assemblies 22 up, because it is very likely that the vehicle will have reached its planing phase. Of course, the effective speed of the water vehicle may also be sensed from the log or as a GPS signal and can be integrated by the controller 9 for an exact balance assembly adjustment.

FIG. 5 shows a functional diagram of the trim control for stern drives 16 including the command input means 2, the rotary speed by means of the rotary speed sensor 19 or the throttle lever 28, the odometer 26 as well as the steering wheel 20, as well as the acting cylinders 21 on the stern drive 16 with the engine 23 and the pressure reservoir 24 and the lock valve 25 for varying the trim rate of the stern drive.

The means 2,9,19,28,24,25 may also be used for adjusting the trim of a stern drive. The correct trimming of a stern drive can ideally be realised by involving a speed log or a GPS signal. Depending on the effective speed, the stored characteristic data for the water vehicle is set by means of the odometer 26 on the acting cylinder 21 provided on the stern drive 16, the corresponding trim is set for this, i.e. the trim of the stern drive 16 normally moves between positions N and H. In rough seas it may be advisable to position the stern drive 16 in the S direction, in order to apply load on the bow, so that this will be raised to a lesser degree when getting in contact with the waves. An inclination sensor (not shown here), which measures the movements about the transverse axis and registers them over a period of time, can therefore generate a damping of the wave impact by way of trimming the stern drive 16 in towards position S, as a result of which a manual positioning of the trim is achieved by means of buttons. A special position is the acceleration of the water vehicle: the pilot can not only move the balance assemblies 22 downwards by using the quick buttons 6, but can at the same time also pivot the trim of the stern drive 16 to the stop of position S, or by using the automatic mode, i.e. as soon as, at low rotary speeds, the rotary speed of the engine has increased to the corresponding Δrpm/t value or the throttle lever 28 is changed by the corresponding value of the angular adjustment ΔW/t, the balance assemblies 22 immediately move downwards and the stern drive—or in the case of a dual system both stern drives at the same time—pivots into the S position and will not pivot back into the N position until a corresponding period of time has elapsed or a certain speed has been reached according to the log or GPS measurement or a certain rotary speed has been reached or no change in rotary speed occurs any more. Additionally, the pivot operation can be made faster by ensuring that the acting cylinder 21 on the stern drive 16 is also connected to the pressure reservoir 24 and the controller 9 opens the lock valve 25 at a suitable time, so that the stern drive 16 takes up the S position extremely rapidly.

Also, during planing and in the N position of the stern drive 16, if the rotary speed is quickly reduced or the throttle lever 28 is quickly moved back, the stern drive 16 can be pivoted into the S position and the balance assemblies 22 can be moved downwards, so that the frequently unpleasant onrush of stern water does not splash over the stern of the water vehicle because the stern is moved slightly upwards by the S position of the stern drive 16 or the lowered balance assemblies 22. If the idle speed has virtually been reached, the balance assemblies 22 are moved fully up and the stern drive is pivoted into the N position.

The adjustment of the stern drive 16 by means of the steering wheel 20 is useful for improving turning manoeuvres of the vehicle: if the stern drive 16 has been extended into the H position and the vehicle turns round a bend, the position of the stern drive 16 impedes the flow of water into the propeller. The controller 9 receives the steering wheel position from the steering wheel sensor 27 and the position of the stern drive 16 from the odometer 26 and reduces in this case the angle of attack in the direction of N or even in the S position. If the steering wheel 20 is adjusted back into the straight position again, the stern drive 16 will move back into the previous position after a brief locking period of the position, because an excessively quick pivoting of the stern drive 16 into the H position can lead to ventilation on the propeller, if the speed is not high enough yet.

Figure 6:
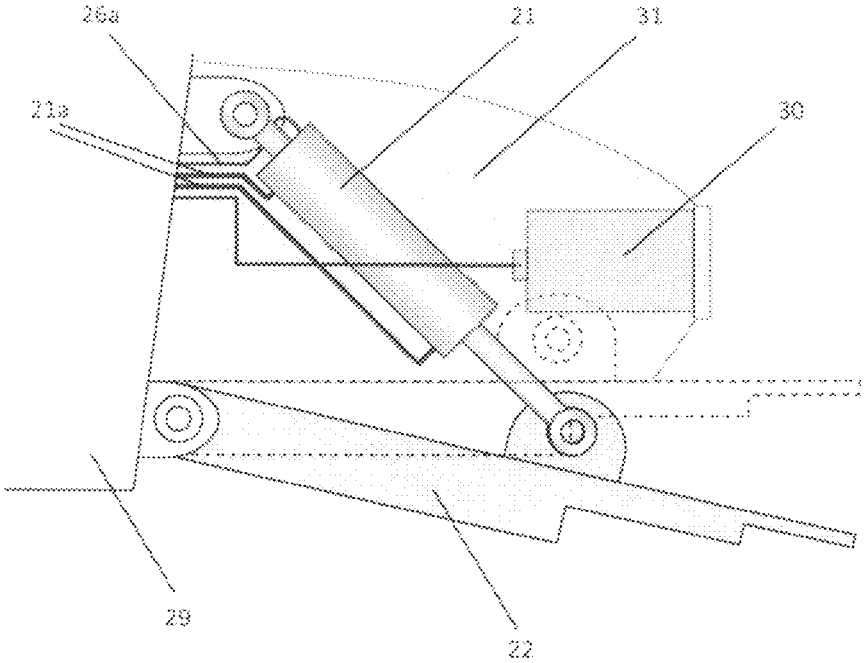
FIG. 6 shows a schematic lateral view of a balance assembly with the acting cylinder and a permanently installed underwater lamp.

FIG. 6 shows a schematic lateral view of a balance assembly 22 on the stern 29 of a water vehicle with the integrated acting cylinder 21, the hydraulic lines 21*a*, the cable 26*a* and a fixed underwater lamp 30 in the housing 31. Balance assemblies 22 are fixed to the stern 29 and act by means of an acting cylinder 21. Such acting cylinders 21 as provided on the stern 29 have a weak point, namely the hydraulic lines 21*a* which are also provided there and which may be damaged by external influences, as well as the odometer 26 or the cable 26*a* therefor. The housing 31 provided on the stern 29, which covers the acting cylinder 21, thus fully protects the hydraulic lines 21*a* and the cable 26*a*. Moreover, one or more underwater lamps 30 may be incorporated in the housing 31, so that there is no need to have large bores in the stern 29 as this has been the case heretofore, which underwater lamps 30 ensure good rearward visibility even during reversing manoeuvres at night time.

The acting cylinder 21 may be a hydraulic or an electric cylinder.

The invention is of course not limited to just the embodiment examples shown and described.

LIST OF REFERENCE NUMERALS

1 Chassis
2 Command input means
3 Micro-switch
4 Rocker
5 Contact pin
6 Quick buttons
7 Neutral buttons
8 Underwater lighting buttons
9 Controller
10 Cable feed-through
11 Fixing screw
12 Bushing
13 Retaining screw
14 Screw
15 Cover housing
16 Stern drive
17 Centring Axis
18 Pictogram
19 Rotary speed sensor
20 Steering wheel
21 Acting cylinder
21*a* Hydraulic line
22 Balance assembly
23 Engine
24 Pressure reservoir
25 Lock valve
26 Odometer
26*a* Cable
27 Steering wheel sensor
28 Throttle lever
29 Stern
30 Underwater lamp
31 Housing
S Acceleration position
N Starting position
H Rapid travel
W Throttle lever angle
rpm Rotary speed
t Time axis

The invention claimed is:

1. A command input device for balance assemblies for balancing stern drives and surface drives on a water vehicle, wherein the command input device activates one or both of the balance assemblies as a result of turning a cover housing, or actuating a rocker or a button, and wherein the button is a quick button in which both of the balance assemblies automatically move into a fully extended position when actuated, or the button is a neutral button in which both of the balance assemblies automatically move into a fully-up position when actuated.

2. The command input device as claimed in claim 1, wherein the balance assemblies automatically move using a time relay or a controller.

3. The command input device as claimed in claim 1, wherein a left-hand turning of the cover housing results in a left-hand orientation and a right-hand turning of the cover housing results in a right-hand orientation in a longitudinal direction of the water vehicle.

4. The command input device as claimed in claim 1, wherein the quick button is connected to a rotary speed sensor, and from a predetermined rotary speed onwards, the balance assemblies allow only a limited angular adjustment.

5. The command input device as claimed in claim 1, wherein a controller detects a rotary speed of an engine and detects, in a predetermined rotary speed window in a case of a rotary speed jump over a time factor, or the controller detects an angular adjustment over a time factor on a throttle lever and issues a command to move the balance assemblies downward, and to move the balance assemblies up once a predetermined lowering position or a predetermined rotary speed has been reached or after a predetermined period of time or speed or in a case of no further increase in rotary speed.

6. The command input device as claimed in claim 1, wherein a controller detects a rotary speed of an engine and in a predetermined rotary speed window in a case of a rotary speed jump over a time factor or the controller detects an angular adjustment over a time factor on a throttle lever and issues a command for pivoting a stern drive of the stern drives into position, and the stern drive is pivoted into position or further in a direction once a predetermined position or a predetermined rotary speed has been reached or after a predetermined period of time or speed or in a case of no further increase in rotary speed.

7. The command input device as claimed in claim 1, wherein a controller detects a rotary speed of an engine and issues a command, within a predetermined rotary speed window in a case of a rotary speed jump over a time factor or in a case of a predetermined angular adjustment over time on the throttle lever, to move the balance assemblies downward or to pivot the stern drive of the stern drives into a position and to open at a same time a lock valve that is linked to a pressure reservoir or to make the engine rotate faster.

8. The command input device as claimed in claim 1, wherein a controller detects a rotary speed of an engine and issues a command, below a predetermined rotary speed limit, but above 100 U/m, to move both of the balance assemblies upward or to pivot a stern drive of the stern drives into position.

9. The command input device as claimed in claim 1, wherein a controller detects a steering wheel sensor, and from a predetermined lower rotary speed limit and a predetermined steering wheel turning angle on a steering wheel towards the left, a left-hand balance assembly of the balance assemblies is moved upwards, and in a case of a predetermined steering wheel turning angle towards the right, a right-hand balance assembly of the balance assemblies is moved upwards.

10. The command input device as claimed in claim 9, wherein in the case of the predetermined steering wheel turning angle on the steering wheel, a stern drive of the stern drives is pivoted into position, and from a predetermined rotary speed on an engine, the stern drive is pivoted into position, and in a case of a straight-on position of the steering wheel, the stern drive returns back into its previous position.

11. The command input device as claimed in claim 1, wherein in a case of a predetermined negative, the balance assemblies are moved downward or a stern drive of the stern drives is pivoted in a direction of position.

12. The command input device as claimed in claim 1, wherein the command input device includes an underwater lighting button or a micro-switch provided with a clicker, so that a command input is also audible.

13. The command input device as claimed in claim 1, wherein a housing is located above the balance assemblies which covers an acting cylinder and the housing can accommodate one or more underwater lamps.

* * * * *